US010748459B2

(12) United States Patent
Kaoh

(10) Patent No.: US 10,748,459 B2
(45) Date of Patent: Aug. 18, 2020

(54) REDUCED COST LOTTERY SIGNS FOR DISPLAYING LOTTERY JACKPOTS OF MILLIONS AND BILLIONS OF DOLLARS

(71) Applicant: Andy K. F. Kaoh, Costa Mesa, CA (US)

(72) Inventor: Andy K. F. Kaoh, Costa Mesa, CA (US)

( * ) Notice: Subject to any disclaimer, the term of this patent is extended or adjusted under 35 U.S.C. 154(b) by 60 days.

(21) Appl. No.: 15/849,301

(22) Filed: Dec. 20, 2017

(65) Prior Publication Data

US 2019/0189036 A1 Jun. 20, 2019

(51) Int. Cl.

| | |
|---|---|
| ***G09F 9/33*** | (2006.01) |
| ***G09F 13/00*** | (2006.01) |
| ***G09F 15/00*** | (2006.01) |
| *G09F 13/22* | (2006.01) |
| *G09F 13/18* | (2006.01) |

(52) U.S. Cl.

CPC ..... *G09F 9/33* (2013.01); *G09F 13/005* (2013.01); *G09F 15/005* (2013.01); *G09F 2013/1845* (2013.01); *G09F 2013/222* (2013.01)

(58) Field of Classification Search

CPC ..... G09F 2013/1845
USPC ..... 40/544, 451
See application file for complete search history.

(56) References Cited

U.S. PATENT DOCUMENTS

| | | | |
|---|---|---|---|
| 5,061,921 | A | 10/1991 | Lesko et al. |
| 5,207,493 | A | 5/1993 | Murase et al. |
| 5,216,595 | A | 6/1993 | Protheroe |
| 5,283,968 | A | 2/1994 | Williams |
| 5,390,436 | A | 2/1995 | Ashall |
| 5,408,387 | A | 4/1995 | Murase et al. |
| 5,410,454 | A | 4/1995 | Murase et al. |
| 6,094,849 | A | 8/2000 | Phillips et al. |
| 6,121,875 | A | 9/2000 | Hamm et al. |
| 6,271,814 | B1 | 8/2001 | Kaoh |
| 6,481,130 | B1 | 11/2002 | Wu |
| 6,568,821 | B1 | 5/2003 | Page et al. |
| 6,729,057 | B1 | 5/2004 | Lu |
| 6,821,007 | B1 | 11/2004 | Olman et al. |
| 6,976,330 | B2 | 12/2005 | Milliken |
| 7,064,673 | B1 | 6/2006 | Bonham |
| 7,164,836 | B2 | 1/2007 | Wright et al. |
| 7,262,707 | B2 | 8/2007 | Kaoh |
| 7,262,708 | B1 | 8/2007 | Addicks |
| 7,273,308 | B2 | 9/2007 | Spero et al. |
| 7,547,251 | B2 | 6/2009 | Walker et al. |
| 7,572,045 | B2 | 8/2009 | Hoelen et al. |
| 7,627,497 | B2 | 12/2009 | Szrek et al. |
| 7,681,347 | B1 | 3/2010 | Welker et al. |
| 7,780,514 | B2 | 8/2010 | Walker et al. |

(Continued)

*Primary Examiner* — Kristina M Junge

(74) *Attorney, Agent, or Firm* — Myers Andras LLP; Joseph C. Andras

(57) ABSTRACT

Reduced cost, illuminated displays for indicating the current jackpot values are disclosed. The illuminated display comprises a front panel assembly that rests on a base assembly. The base assembly includes a one-piece housing unit that may be formed in a cost-effective manufacturing process such as through injection molding. The base assembly also holds modular electronic devices such as a LED array formed on a single printed circuit board, a power and control board for energizing the LED array to indicate the current jackpot value, as well as other modular components.

20 Claims, 7 Drawing Sheets

(56) References Cited

U.S. PATENT DOCUMENTS

| | | | | |
|---|---|---|---|---|
| 7,839,265 | B2 | 11/2010 | Picard et al. | |
| 7,878,895 | B2 | 2/2011 | Penrice | |
| 7,903,194 | B2 | 3/2011 | Epstein et al. | |
| 7,941,269 | B2 | 5/2011 | Laumeyer et al. | |
| 7,976,390 | B2 | 7/2011 | Schneider et al. | |
| 8,103,550 | B2 | 1/2012 | Tessitore et al. | |
| 8,128,473 | B2 | 3/2012 | Finnochio | |
| 8,131,595 | B2 | 3/2012 | Lee et al. | |
| 8,578,641 | B2 | 11/2013 | Suciu et al. | |
| 8,826,572 | B2 | 9/2014 | Kaoh | |
| 9,940,855 | B2 | 4/2018 | Kaoh | |
| 10,403,178 | B2 | 9/2019 | Kaoh | |
| 2002/0121034 | A1 | 9/2002 | Schmitt | |
| 2005/0246927 | A1 | 11/2005 | Krawinkel | |
| 2008/0079538 | A1 | 4/2008 | Davis | |
| 2009/0025264 | A1 | 1/2009 | Daimon et al. | |
| 2010/0213836 | A1* | 8/2010 | Liao | G09F 9/33 313/513 |
| 2010/0307041 | A1 | 12/2010 | Tian et al. | |
| 2016/0042673 | A1* | 2/2016 | Wilson | G09F 9/33 40/541 |

* cited by examiner

REDUCED COST LOTTERY SIGNS FOR DISPLAYING LOTTERY JACKPOTS OF MILLIONS AND BILLIONS OF DOLLARS

BACKGROUND OF THE INVENTION

1. Field of the Invention

The present invention relates in general to lottery display signs. More particularly, the invention is directed to lottery display signs having a one-piece base with modular components.

2. Description of the Related Art

Lottery signs which display the current jackpot are ubiquitous and can be found in gas stations and convenience stores for example. However, many lottery signs that display the current jackpot in real-time may be too costly for smaller establishments. The manufacture of conventional lottery signs may be costly as the assembly may be labor-intensive and may rely on many customized mechanical parts and electronics.

Accordingly, a need exists to provide lower-cost lottery signs.

SUMMARY OF THE INVENTION

In the first aspect, an illuminated display for displaying a lottery jackpot value is disclosed. The display comprises a front panel assembly comprising a backlight panel having one or more windows, a snap frame panel unit mounted at the top on the backlight panel configured for releasably securing a replaceable graphic overlay, and one or pockets partially extending above the backlight panel configured for receiving the replaceable graphic overlay. The display further comprises a base assembly unit comprising a one-piece generally rectangular housing unit having a flat inner surface surrounded by a raised shoulder formed at the perimeter of the front surface, the raised shoulder configured to receive and secure the front panel assembly, the inner surface and the raised shoulder forming an internal cavity, and a light emitting array of light emitting diodes ("LEDs") positioned behind and viewable through the window in the backlight panel, the light emitting array configured to provide visible indicia of at least numerals.

In a first preferred embodiment, the raised shoulder of the housing unit comprises a vertical wall formed at and emerging away perpendicularly from the outer perimeter of the inner surface, the vertical wall having a proximal end positioned at the perimeter of the inner surface and a distal end positioned away from the inner surface, a horizontal surface formed at and emerging away perpendicularly from the distal end of the vertical wall, the horizontal surface having a proximal end positioned at the distal end of the vertical wall, the horizontal surface having a distal end positioned away from the vertical wall, and a vertical rim positioned at and emerging away perpendicularly from the distal end of the horizontal surface.

The illuminated display preferably further comprises a one-piece currency number scale module comprising of LED arrays which may be illuminated to indicate "MILLION" or "BILLION" and a supporting bracket coupling the currency number scale module to the inner surface of the housing unit. The backlight panel preferably has an aperture configured for receiving the currency number scale module. The light emitting array of light emitting diodes preferably comprises a one-piece numerical LED module having a one-piece printed circuit board coupled to the array of LEDs, wherein the LEDs are positioned to form an "888" pattern.

The illuminated display preferably further comprises a one-piece power and control board formed on a single printed circuit board, the power and control board configured to receive lottery jackpot information and to selectively energize the light emitting array of light emitting diodes. The housing unit is preferably formed in plastic. The illuminated display preferably further comprises a replaceable graphic overlay placed on the front surface of the housing unit, the replaceable graphic overlay configured to be backlit by the backlight panel, the graphic overlay having visible indicia.

In a second aspect, an illuminated display for displaying a lottery jackpot value is disclosed. The display comprises a front panel assembly configured for illuminating and securing a replaceable graphic overlay, the front panel assembly having at least one window. The display further comprises a base assembly unit comprising a one-piece generally rectangular housing unit having a flat inner surface surrounded by a raised shoulder formed at the perimeter of the front surface, the raised shoulder configured to receive and secure the front panel assembly, the inner surface and the raised shoulder forming an internal cavity, and a light emitting array of light emitting diodes ("LEDs") positioned behind and viewable through the window in the front panel assembly, the light emitting array configured to provide visible indicia of at least numerals.

In a second preferred embodiment, the raised shoulder of the housing unit comprises a vertical wall formed at and emerging away perpendicularly from the outer perimeter of the inner surface, the vertical wall having a proximal end positioned at the perimeter of the inner surface and a distal end positioned away from the inner surface, a horizontal surface formed at and emerging away perpendicularly from the distal end of the vertical wall, the horizontal surface having a proximal end positioned at the distal end of the vertical wall, the horizontal surface having a distal end positioned away from the vertical wall, and a vertical rim positioned at and emerging away perpendicularly from the distal end of the horizontal surface.

The illuminated display preferably further comprises a one-piece currency number scale module comprising of LED arrays which may be illuminated to indicate "MILLION" or "BILLION" and a supporting bracket coupling the currency number scale module to the inner surface of the housing unit. The front panel assembly preferably has an aperture configured for receiving the currency number scale module.

The light emitting array of light emitting diodes preferably comprises a one-piece numerical LED module having a one-piece printed circuit board and coupled to the array of LEDs, wherein the LEDs are positioned to form an "888" pattern. The illuminated display preferably further comprising a one-piece power and control board formed on a single printed circuit board, the power and control board configured to receive lottery jackpot information and to selectively energize the light emitting array of light emitting diodes. The housing unit is preferably formed in plastic. The illuminated display preferably further comprising a replaceable graphic overlay placed on the front surface of the housing unit, the replaceable graphic overlay configured to be backlit by the front panel assembly, the graphic overlay having visible indicia In a third aspect, an illuminated display for displaying a lottery jackpot value is disclosed. The display comprises a front panel assembly comprising a backlight panel having one or more windows, a snap frame panel unit mounted on the backlight panel by a hinge connector, and one or pockets partially extending above the backlight panel configured for receiving a replaceable graphic overlay. The illuminated display further comprises a base assembly unit comprising a one-piece generally rectangular housing unit having a flat inner surface surrounded by a raised shoulder formed at the perimeter of the front surface, the raised shoulder configured to receive and secure the front panel assembly, the inner surface and the raised shoulder forming an internal cavity. The base assembly unit further comprises a one-piece numerical LED module having a one-piece printed circuit board and coupled to an array of LEDs, the numerical LED module positioned behind and viewable through the window in the backlight panel, a one-piece currency number scale LED module comprising of LED arrays which may be illuminated to indicate "MILLION" or "BILLION" and a one-piece power and control board formed on a single printed circuit board, the power and control board configured to receive lottery jackpot information and to selectively energize the numerical LED module and the currency number LED module.

In a preferred embodiment, the raised shoulder of the housing unit comprises a vertical wall formed at and emerging away perpendicularly from the outer perimeter of the inner surface, the vertical wall having a proximal end positioned at the perimeter of the inner surface and a distal end positioned away from the inner surface, a horizontal surface formed at and emerging away perpendicularly from the distal end of the vertical wall, the horizontal surface having a proximal end positioned at the distal end of the vertical wall, the horizontal surface having a distal end positioned away from the vertical wall, and a vertical rim positioned at and emerging away perpendicularly from the distal end of the horizontal surface. The illuminated display preferably further comprising a replaceable graphic overlay placed on the front surface of the housing unit, the replaceable graphic overlay configured to be backlit by the backlight panel, the graphic overlay having visible indicia. The housing unit is preferably formed in plastic.

These and other features and advantages of the invention will become more apparent with a description of preferred embodiments in reference to the associated drawings.

DETAILED DESCRIPTION OF THE PREFERRED EMBODIMENTS

Government operated lotteries are very popular in the United States as well as in many countries throughout the world. Many venues for purchasing lottery tickets may use a lottery sign to indicate to the public that lottery tickets are available. Some lottery signs may simply indicate that lottery tickets are available from an establishment, while other, more sophisticated lottery signs may display the current lottery jackpot. Many consumers may be persuaded to purchase lottery tickets when the lottery jackpot is large or near record amounts. However, many conventional lottery signs which display the current jackpot may be unaffordable for smaller venues.

Reduced cost, illuminated displays for indicating the current jackpot values are contemplated in one or more embodiments. In an embodiment, the illuminated display comprises a front panel assembly that is secured to a base assembly. The base assembly includes a one-piece housing unit that may be formed in a cost-effective process such as through injection molding. The base assembly also holds modular electronic devices such as a LED array formed on a single printed circuit board, a power and control board for energizing the LED array to indicate the current jackpot value, as well as other modular components. Manufacturing costs—particularly assembly costs—may be reduced by employing a one-piece housing unit to which one-piece modules may be attached.

Teachings relating to the illuminated display signs disclosed in U.S. patent application Ser. No. 13/436,719 filed Mar. 30, 2012 entitled "ADJUSTABLE ILLUMINATED LOTTERY SIGN" which issued as U.S. Pat. No. 8,826,572 on Sep. 9, 2014, as well as U.S. patent application Ser. No. 14/861,069 filed on Sep. 22, 2015 entitled "LOTTERY SIGNS FOR DISPLAYING LOTTERY JACKPOTS OF MILLIONS AND BILLIONS OF DOLLARS" may be employed herein and the disclosures of which are incorporated herein by reference in their entirety. Embodiments described herein describe lotteries with jackpots listed in dollars. However, it shall be understood that lottery displays depicting other currencies are contemplated in one or more embodiments. Embodiments described herein make reference to LED modules having multiple discrete LEDs positioned to form the shape of numerals and letters. It shall be understood that the teachings of LED segmented displays and discrete LEDs are interchangeable, and may be applied to other forms of segmented displays or groups of discrete LED devices.

Figure 1:
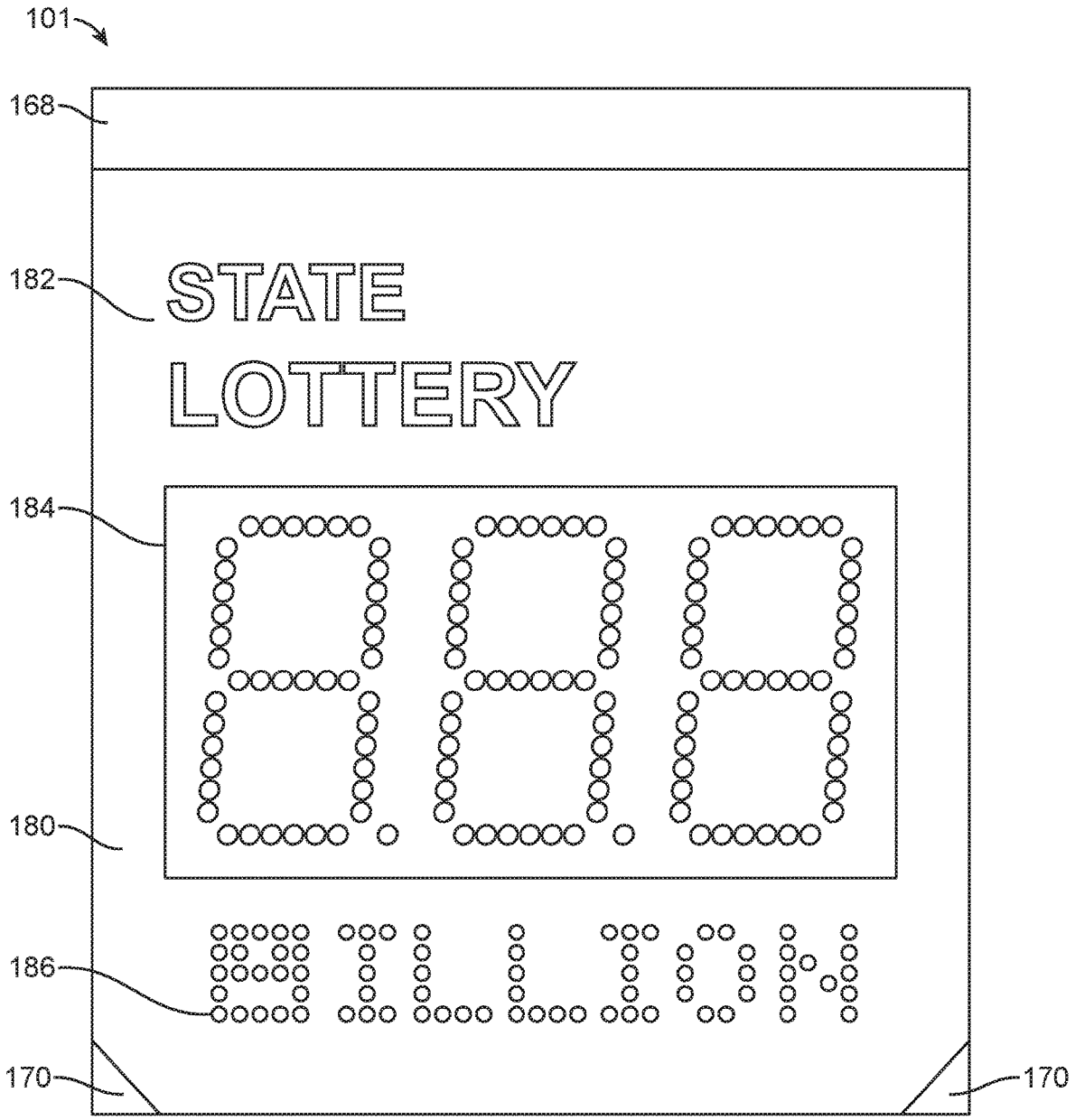
FIG. 1 is a front view of a lottery sign having a graphic overlay in one or more embodiments.
Figure 2:
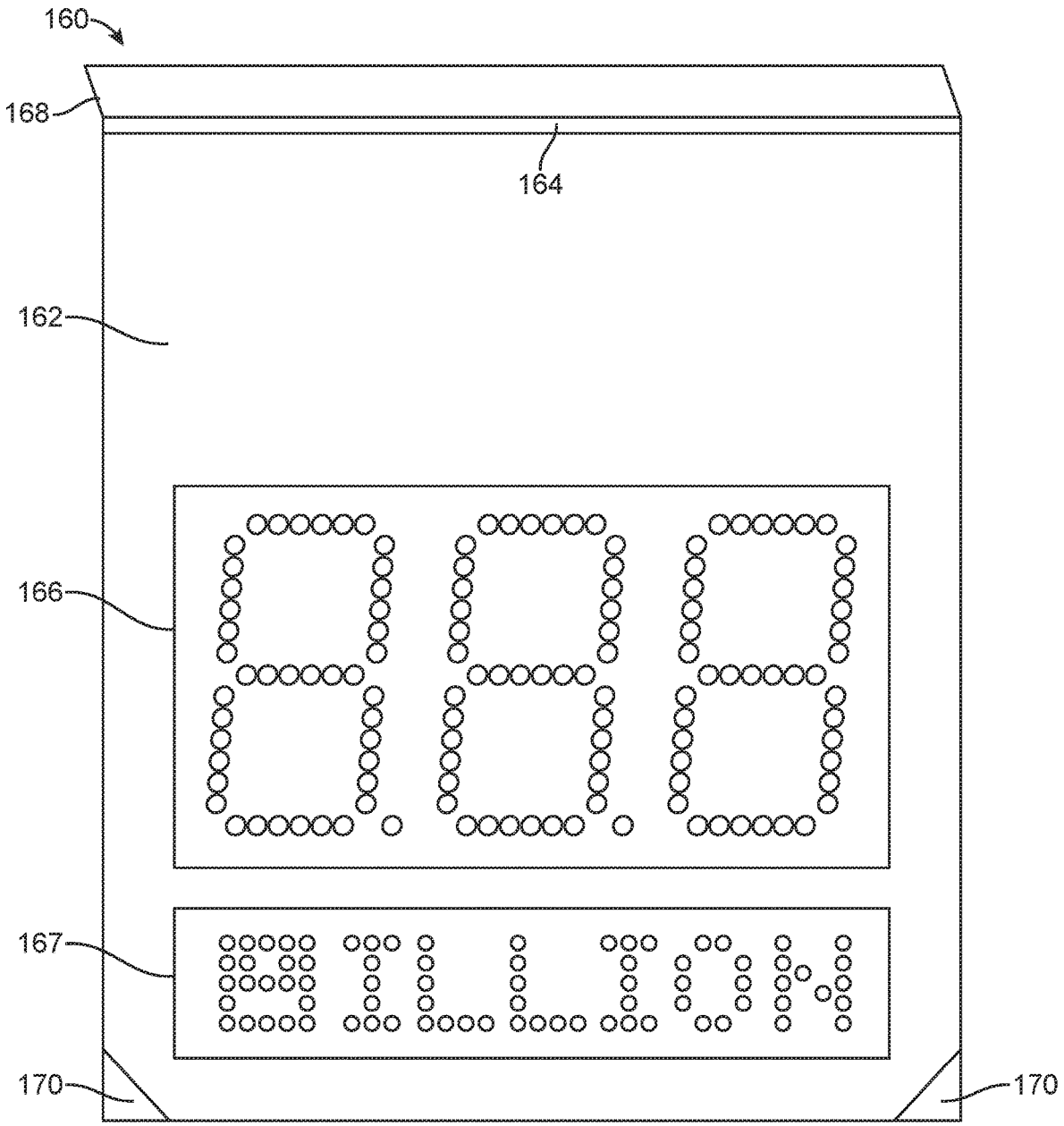
FIG. 2 is a front view of the lottery sign with the graphic overlay removed.

FIG. 1 is a front view of an illuminated lottery display 101 in one or more embodiments. The illuminated display 101 has a graphic overlay 180 which is backlit by a backlight panel 162 as shown in FIG. 2. The graphic overlay 180 has indicia of a lottery 182, a window 184 for passing the illuminated numerical value of the lottery jackpot, as well as an array of windows 186 for passing the currency number scale of either "MILLION" or "BILLION."

FIG. 2 is a front view of the front panel assembly 160 with the graphic overlay 180 removed. The front panel assembly 160 has a backlight panel 162 having a window 166 and an aperture 167. The backlight panel 162 may be fabricated out of plastic in an embodiment. The front panel assembly 160 also has a snap frame panel unit 168 and two triangularly shaped pockets 170 for securing the graphic overlay 180. The snap frame panel 168 can be flipped from being flush with the front panel assembly 160 as seen in FIG. 1, to being flipped away from the front panel assembly 160 as seen in FIG. 2.

Figure 4:
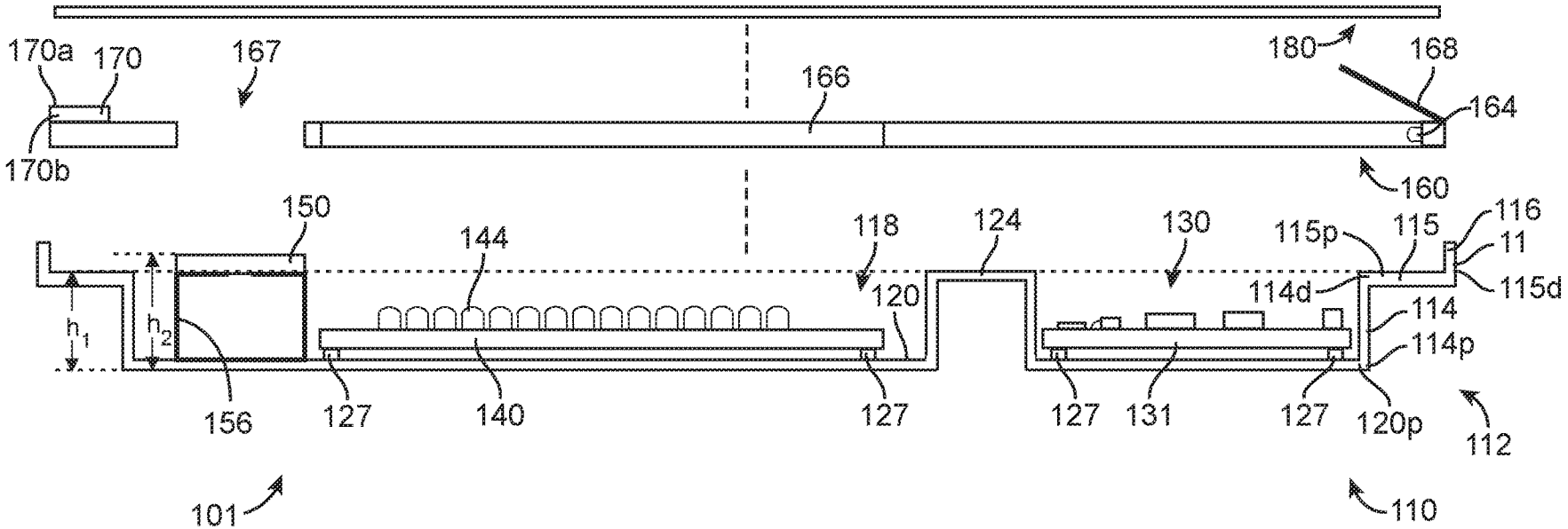
FIG. 4 is a side, cutaway view of the exploded lottery sign.

The pockets 170 are formed on the left hand side and the right hand side of the bottom section of the front panel assembly 160. As illustrated in FIGS. 1, 2, and 4, each pocket has a front surface 170*a* that is parallel with the front surface of the front panel assembly 160 which is connected to the front panel assembly 160 with side surfaces 170*b*. The pockets 170 may be integral components of the front panel assembly 160, or may be separate components that are affixed to the corners of the front panel assembly 160. In an embodiment, the pockets 170 are fabricated out of plastic.

A user may install a graphic overlay 160 by simply placing the snap frame panel unit 168 away from the front panel assembly 160 (as illustrated in FIG. 2), inserting a graphic overlay 180 into the two pockets 170, and then flipping the snap panel assembly 168 downward (as seen in FIG. 1) to secure the graphic overlay 180 to the front panel assembly 160.

The top edge of the backlight panel 162 is connected to LED light sources 164. The light from the LED light sources 164 is transmitted downward through the edge of the transparent backlight panel 162 to reflect from the appropriate parallel internal surfaces of the transparent backlight panel 162 by a dispersion section. The dispersion section may comprise an array of dispersion dots printed on the rear surface of backlight panel 162 for reflecting the light from LED light sources 164 outward through the front of the transparent backlight panel 162. The reflected light travels through the graphic overlay 180.

Figure 3:
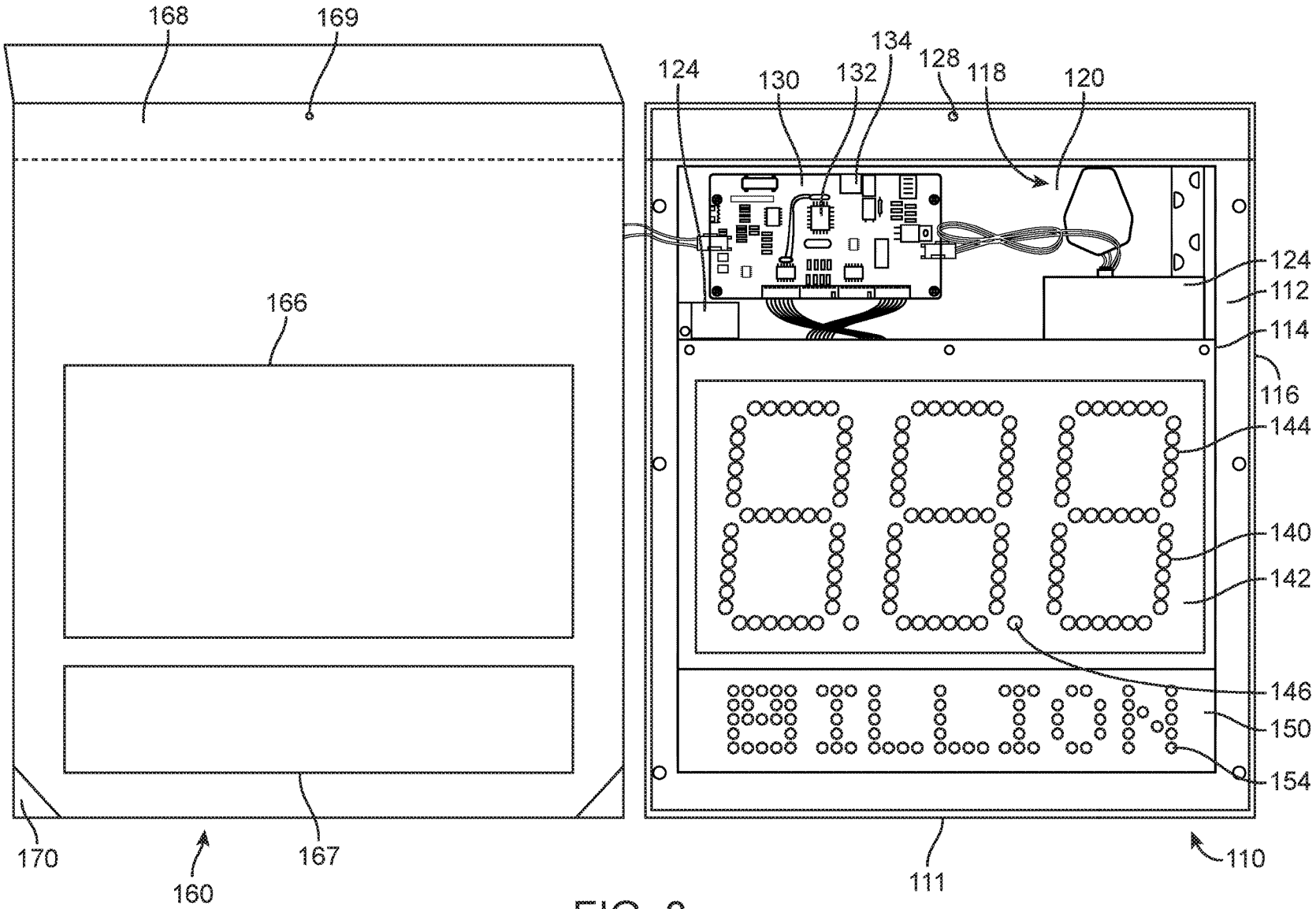
FIG. 3 is a front view of a partially disassembled lottery sign showing the front panel assembly and the base assembly.

FIG. 3 is a front view of a partially disassembled lottery sign showing the front panel assembly 160 and the base assembly 110. FIG. 4 is a side, cutaway view of the exploded lottery sign. The base assembly unit 110 comprises a one-piece generally rectangular housing unit 111 having a flat inner surface 120 surrounded by a raised shoulder 112 formed at the perimeter of the inner surface 120. The raised shoulder 112 is configured to receive and secure the front panel assembly 160. The inner surface and the raised shoulder form an internal cavity 118. In an embodiment, the raised shoulder 112 of the housing unit 111 comprises a vertical wall 114 formed at and emerging away perpendicularly from the outer perimeter 120*p* of the inner surface 120. The vertical wall 114 has a proximal end 114*p* positioned at the perimeter 120*p* of the inner surface 120 and a distal end 114*d* positioned away from the inner surface 120. In an embodiment, the raised shoulder 112 of the housing unit 111 further comprises a horizontal surface 115 formed at and emerging away perpendicularly from the distal end 114*d* of the vertical wall 114. The horizontal surface 115 has a proximal end 115*p* positioned at the distal end 114*d* of the vertical wall 114. The horizontal surface 115 has a distal end 115*d* positioned away from the vertical wall 114. The horizontal surface 115 is positioned to be offset from the back of the housing unit 111 by a distance represented by $h_1$. The raised shoulder 112 further comprises a vertical rim 116 positioned at and emerging away perpendicularly from the distal end 115*d* of the horizontal surface 115. The housing unit 111 may also have one or more integrated raised surfaces or spacers 124 which is also positioned to be offset from the back of the housing unit 111 by a distance represented by $h_1$. When the illuminated sign 101 is assembled, the front panel assembly 160 is positioned against the horizontal surface 115 and the one or more integrated spacers 124.

In an embodiment, the one-piece housing unit 111 may be formed in plastic employing a cost-effective manufacturing process such as injection molding. As the housing unit 111 is formed as a single piece, assembly may be greatly simplified as compared with other base units which may comprise multiple frames and components.

In an embodiment, the threaded hole 169 on the front panel assembly 160 is positioned over hole 128 on the base assembly 110. A screw (not shown) placed through the holes 168 and 128 may be employed to secure the front panel assembly 160 to the base assembly 110.

In an embodiment, the housing unit 111 is configured to receive and secure electronic modules via mounting spacers 127 for indicating the current value of the lottery jackpot. For example, the housing unit 111 may secure a light emitting array 140 of light emitting diodes ("LEDs") positioned behind and viewable through the window 166 in the backlight panel 162. The light emitting array 140 is configured to provide visible indicia of at least numerals. In an embodiment, the light emitting array 140 of light emitting diodes comprises a one-piece numerical LED module having a one-piece printed circuit board 142 and coupled to the array of LEDs 144 such that the LEDs 144 are positioned to form an "888" pattern. In an embodiment, the light emitting array 140 further comprises one or more LED decimal points 146.

In an embodiment, the housing unit 111 may secure a one-piece currency number scale module 150 comprising of LED arrays which may be illuminated to indicate "MILLION" or "BILLION." The currency number scale module 150 has an exemplary printed circuit board 152 having discrete LEDs 154 positioned to form indicia of either "MILLION" or "BILLION." The printed circuit board 152 has multiple discrete LEDs 154 positioned to form a capital letter "M" or a capital letter "B" as well as the series of LED elements configured to provide visual indicia of "ILLION" placed immediately to the right of the M/B LED display.

In an embodiment, the housing unit holds a one-piece power and control board 130 formed on a single printed circuit board 131 such that the power and control board 130 is configured to receive lottery jackpot information and to selectively energize the light emitting array of light emitting diodes. The power and control board 130 may have a controller 132 and a transceiver 134.

Figure 5:
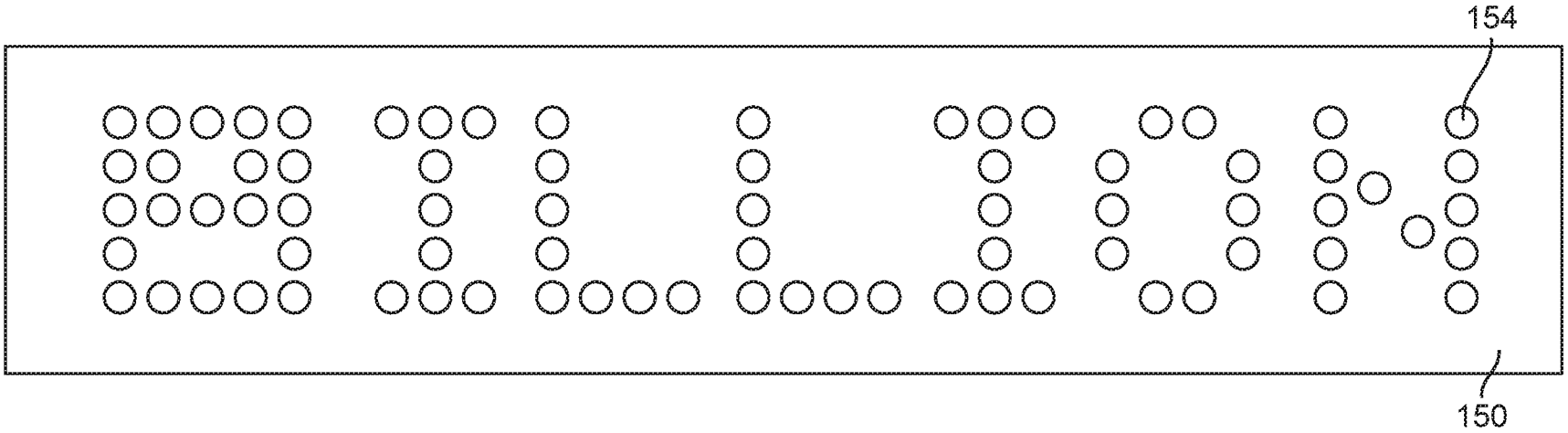
FIG. 5 is a front view of the one-piece currency number scale module.
Figure 6:
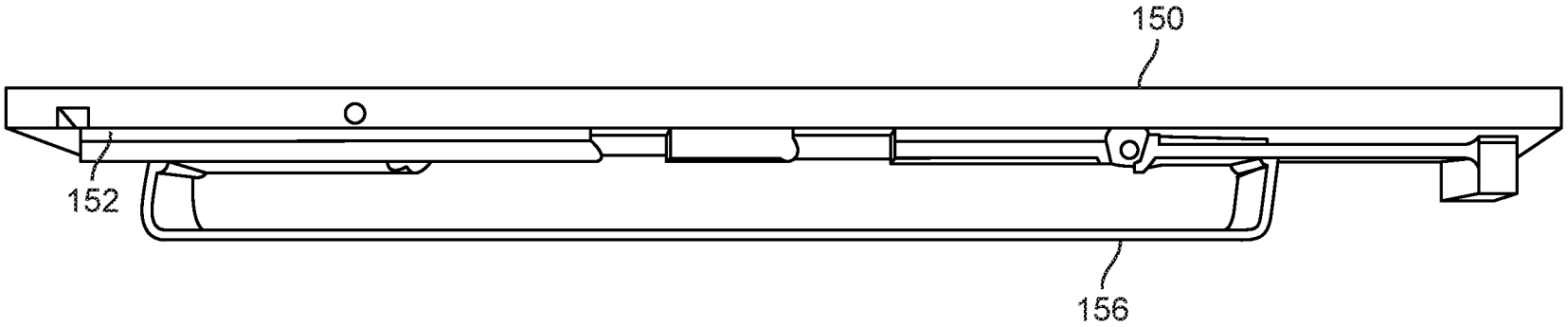
FIG. 6 is a side view of the currency number scale coupled to a spacer.

FIG. 5 is a front view of the one-piece currency number scale module, and FIG. 6 is a side view of the currency number scale 150 coupled to a spacer 156. The currency number scale module 150 may be attached to the housing unit 111 with a supporting bracket 156 coupling the currency number scale module to the inner surface 120 of the housing unit 111. The supporting bracket 156 is configured to position the top of the currency number scale 150 at a height $h_2$ which is greater than the height of the horizontal surfaces 115 of the raised shoulder 112. In an embodiment, the backlight panel 162 has an aperture 167 configured for receiving the currency number scale module 150 such that the currency number scale 150 is in close proximity of the windows 186 of the graphic overlay 180.

Figure 7:
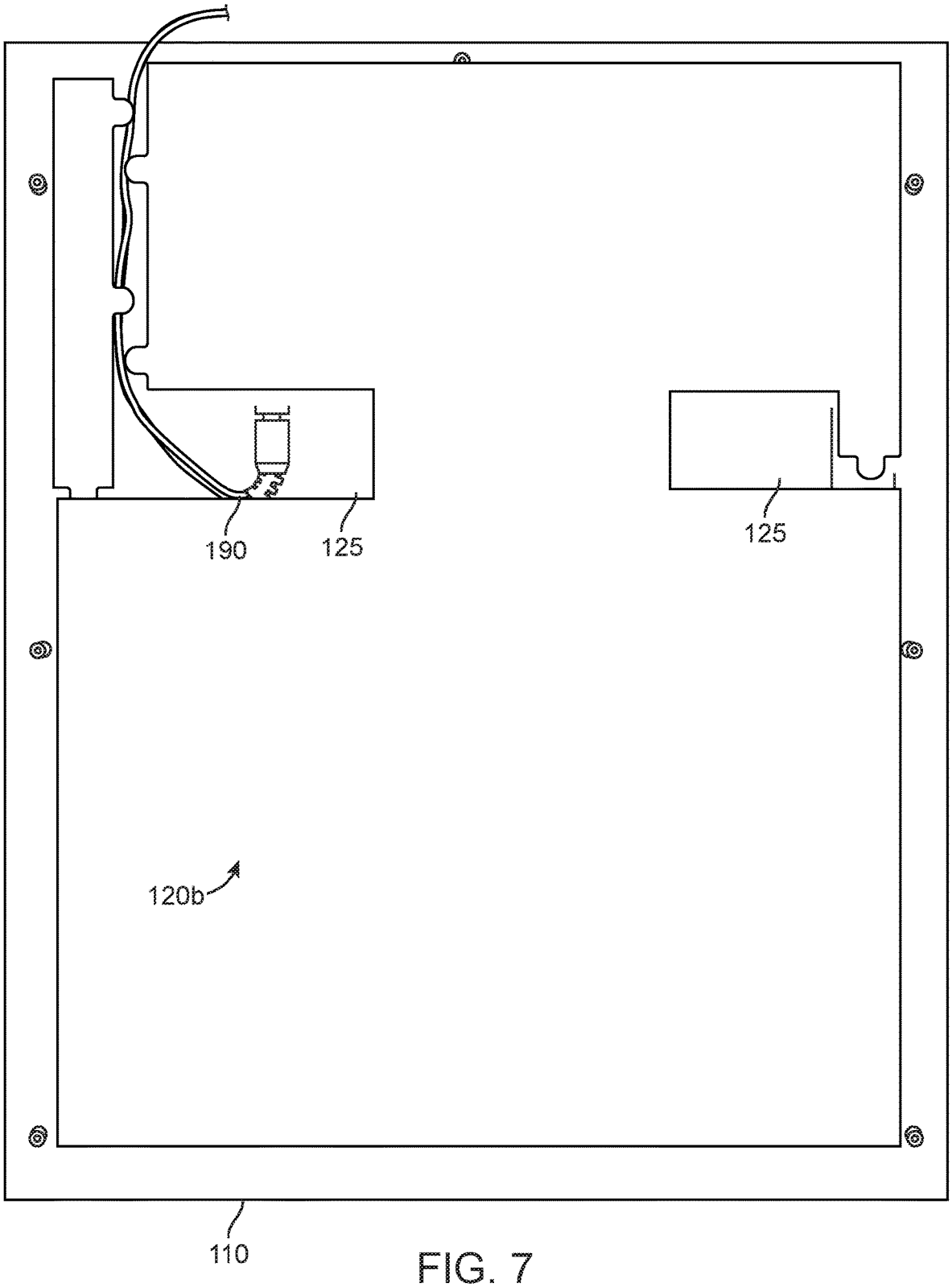
FIG. 7 is the back view of the lottery sign.

FIG. 7 is the back view of the lottery sign 101. The back surface 120*b* of the inner surface 120 is generally flat to permit the illuminated sign 101 to be conveniently mounted to a wall. The raised spacers 124 creates an associated cavities 125 which can be used to route cables such as the power cord 190 to the illuminated sign 101.

As described herein, the use of a base unit 111 that is formed as a single piece may reduce assembly time as compared to conventional base units which may be formed with multiple components and frames. Moreover, the use of modular, one-piece components such as LED displays and control boards may also reduce assembly time. Hence, embodiments described herein may be fabricated with less labor, which may serve to reduce the costs of manufacturing the illuminated sign 101.

Although the invention has been discussed with reference to specific embodiments, it is apparent and should be understood that the concept can be otherwise embodied to achieve the advantages discussed. The preferred embodiments above have been described primarily as electronic lottery signs for displaying jackpots in the millions and billions of dollars having reduced manufacturing costs. In this regard, the foregoing description of the lottery signs is presented for purposes of illustration and description. It shall be apparent that various displays would benefit from having a display showing millions or billions of dollars.

Furthermore, the description is not intended to limit the invention to the form disclosed herein. Accordingly, variants and modifications consistent with the following teachings, skill, and knowledge of the relevant art, are within the scope of the present invention. The embodiments described herein are further intended to explain modes known for practicing the invention disclosed herewith and to enable others skilled in the art to utilize the invention in equivalent, or alternative embodiments and with various modifications considered necessary by the particular application(s) or use(s) of the present invention.

What is claimed is:

1. An illuminated display for displaying a lottery jackpot value, the display comprising:

a front panel assembly comprising:

a backlight panel having one or more windows;

a snap frame panel unit mounted at a top on the backlight panel configured for releasably securing a replaceable graphic overlay; and, one or more pockets partially extending above the backlight panel configured for receiving the replaceable graphic overlay; and, a base assembly unit comprising:

a one-piece generally rectangular housing unit having a flat inner surface surrounded by a raised shoulder formed at a perimeter of a flat inner surface, the raised shoulder configured to receive and secure the front panel assembly, the flat inner surface and the raised shoulder forming an internal cavity; the raised shoulder comprising a vertical wall formed at and emerging away perpendicularly from the perimeter of the flat inner surface, the vertical wall having a proximal end positioned at the perimeter of the flat inner surface and a distal end positioned away from the flat inner surface; and, a horizontal surface formed at and emerging away perpendicularly from the distal end of the vertical wall, the horizontal surface having a proximal end positioned at the distal end of the vertical wall, the horizontal surface having a distal end positioned away from the vertical wall, the horizontal surface supporting the front panel assembly; and, a light emitting array of light emitting diodes ("LEDs") positioned behind and viewable through the window in the backlight panel, the light emitting array configured to provide visible indicia of at least numerals.

2. The illuminated display for displaying a lottery jackpot value of claim 1, wherein the raised shoulder of the housing unit further comprises a vertical rim positioned at and emerging away perpendicularly from the distal end of the horizontal surface.

3. The illuminated display for displaying a lottery jackpot value of claim 1, further comprising:

a one-piece currency number scale module comprising of LED arrays which may be illuminated to indicate "MILLION" or "BILLION" and, a supporting bracket coupling the currency number scale module to the inner surface of the housing unit.

4. The illuminated display for displaying a lottery jackpot value of claim 3, wherein the backlight panel has an aperture configured for receiving the currency number scale module.

5. The illuminated display for displaying a lottery jackpot value of claim 1, wherein the light emitting array of light emitting diodes comprises a one-piece numerical LED module having a one-piece printed circuit board coupled to the array of LEDs, wherein the LEDs are positioned to form an "888" pattern.

6. The illuminated display for displaying a lottery jackpot value of claim 1, further comprising a one-piece power and control board formed on a single printed circuit board, the power and control board configured to receive lottery jackpot information and to selectively energize the light emitting array of light emitting diodes.

7. The illuminated display for displaying a lottery jackpot value of claim 1, wherein the housing unit is formed in plastic.

8. The illuminated display for displaying a lottery jackpot value of claim 1 further comprising a replaceable graphic overlay placed on a front surface of the backlight panel, the replaceable graphic overlay configured to be backlight by the backlight panel, the graphic overlay having visible indicia.

9. An illuminated display for displaying a lottery jackpot value, the display comprising:

a front panel assembly configured for illuminating and securing a replaceable graphic overlay, the front panel assembly having at least one window; and a base assembly unit comprising:

a one-piece generally rectangular housing unit having a flat inner surface surrounded by a raised shoulder formed at a perimeter of the flat inner surface, the raised shoulder configured to receive and secure the front panel assembly, the flat inner surface and the raised shoulder forming an internal cavity; the raised shoulder comprising a vertical wall formed at and emerging away perpendicularly from the perimeter of the flat inner surface, the vertical wall having a proximal end positioned at the perimeter of the flat inner surface and a distal end positioned away from the flat inner surface; and, a horizontal surface formed at and emerging away perpendicularly from the distal end of the vertical wall, the horizontal surface having a proximal end positioned at the distal end of the vertical wall, the horizontal surface having a distal end positioned away from the vertical wall, the horizontal surface supporting the front panel assembly; and a light emitting array of light emitting diodes ("LEDs") positioned behind and viewable through the window in the front panel assembly, the light emitting array configured to provide visible indicia of at least numerals.

10. The illuminated display for displaying a lottery jackpot value of claim 9, wherein the raised shoulder of the housing unit further comprises a vertical rim positioned at and emerging away perpendicularly from the distal end of the horizontal surface.

11. The illuminated display for displaying a lottery jackpot value of claim 9, further comprising:

a one-piece currency number scale module comprising of LED arrays which may be illuminated to indicate "MILLION" or "BILLION;" and, a supporting bracket coupling the currency number scale module to the inner surface of the housing unit.

12. The illuminated display for displaying a lottery jackpot value of claim 11, wherein the front panel assembly has an aperture configured for receiving the currency number scale module.

13. The illuminated display for displaying a lottery jackpot value of claim 9, wherein the light emitting array of light emitting diodes comprises a one-piece numerical LED module having a one-piece printed circuit board and coupled to the array of LEDs, wherein the LEDs are positioned to form an "888" pattern.

14. The illuminated display for displaying a lottery jackpot value of claim 9, further comprising a one-piece power and control board formed on a single printed circuit board, the power and control board configured to receive lottery jackpot information and to selectively energize the light emitting array of light emitting diodes.

15. The illuminated display for displaying a lottery jackpot value of claim 9, wherein the housing unit is formed in plastic.

16. The illuminated display for displaying a lottery jackpot value of claim 9 further comprising a replaceable graphic overlay placed on a front surface of the backlight panel, the replaceable graphic overlay configured to be backlight by the front panel assembly, the graphic overlay having visible indicia.

17. An illuminated display for displaying a lottery jackpot value, the display comprising:

a front panel assembly comprising:

a backlight panel having one or more windows;

a snap frame panel unit mounted on the backlight panel by a hinge connector; and, one or more pockets partially extending above the backlight panel configured for receiving a replaceable graphic overlay; and, a base assembly unit comprising:

a one-piece generally rectangular housing unit having a flat inner surface surrounded by a raised shoulder formed at a perimeter of the flat inner surface, the raised shoulder configured to receive and secure the front panel assembly, the flat inner surface and the raised shoulder forming an internal cavity; the raised shoulder comprising a vertical wall formed at and emerging away perpendicularly from the perimeter of the flat inner surface, the vertical wall having a proximal end positioned at the perimeter of the flat inner surface and a distal end positioned away from the flat inner surface; and, a horizontal surface formed at and emerging away perpendicularly from the distal end of the vertical wall, the horizontal surface having a proximal end positioned at the distal end of the vertical wall, the horizontal surface having a distal end positioned away from the vertical wall, the horizontal surface supporting the front panel assembly; and, a one-piece numerical LED module having a one-piece printed circuit board and coupled to an array of LEDs, the numerical LED module positioned behind and viewable through the window in the backlight panel;

a one-piece currency number scale LED module comprising of LED arrays which may be illuminated to indicate "MILLION" or "BILLION;" and, a one-piece power and control board formed on a single printed circuit board, the power and control board configured to receive lottery jackpot information and to selectively energize the numerical LED module and the currency number LED module.

18. The illuminated display for displaying a lottery jackpot value of claim 17, wherein the raised shoulder of the housing unit further comprises a vertical rim positioned at and emerging away perpendicularly from the distal end of the horizontal surface.

19. The illuminated display for displaying a lottery jackpot value of claim 17 further comprising a replaceable graphic overlay placed on a front surface of the backlight panel of the front panel assembly, the replaceable graphic overlay configured to be backlight by the backlight panel, the graphic overlay having visible indicia.

20. The illuminated display for displaying a lottery jackpot value of claim 17, wherein the housing unit is formed in plastic.

* * * * *